US008257462B2

(12) United States Patent
Christopherson, Jr. et al.

(10) Patent No.: US 8,257,462 B2
(45) Date of Patent: Sep. 4, 2012

(54) IRON-BASED SINTERED POWDER METAL FOR WEAR RESISTANT APPLICATIONS

(75) Inventors: Denis Boyd Christopherson, Jr., Waupun, WI (US); Leslie John Farthing, Rugby (GB); Jeremy Raymond Koth, Sun Prairie, WI (US)

(73) Assignee: Federal-Mogul Corporation, Southfield, MI (US)

( * ) Notice: Subject to any disclaimer, the term of this patent is extended or adjusted under 35 U.S.C. 154(b) by 160 days.

(21) Appl. No.: 12/579,772

(22) Filed: Oct. 15, 2009

(65) Prior Publication Data

US 2011/0091344 A1 Apr. 21, 2011

(51) Int. Cl.
*B22F 1/00* (2006.01)
*B22F 9/00* (2006.01)
*C22C 33/02* (2006.01)

(52) U.S. Cl. ..... 75/246; 75/231; 75/243; 75/252

(58) Field of Classification Search ..... 75/228–250, 75/255, 252, 253, 254; 419/5–8, 10–23
See application file for complete search history.

(56) References Cited

U.S. PATENT DOCUMENTS 4,344,795 A 8/1982 Endo et al.
4,702,771 A 10/1987 Takagi et al.
4,970,049 A * 11/1990 Baker et al. ..... 419/11
5,108,493 A 4/1992 Causton
5,217,683 A 6/1993 Causton
5,259,860 A 11/1993 Ikenoue et al.
5,286,275 A * 2/1994 Murakami et al. ..... 75/252
5,507,257 A 4/1996 Sakai et al.
5,534,220 A * 7/1996 Purnell et al. ..... 419/45
5,571,305 A 11/1996 Uenosono et al.
5,703,304 A 12/1997 Lindberg
5,784,681 A * 7/1998 Purnell et al. ..... 419/11
5,938,814 A 8/1999 Uenosono et al.

(Continued)

FOREIGN PATENT DOCUMENTS

KR 1019950013635 6/1995

(Continued)

OTHER PUBLICATIONS

Hawley's Condensed Chemical Dictionary, 14th edition, 2002, term: wax.*

*Primary Examiner* — Scott Kastler
*Assistant Examiner* — Vanessa Luk
(74) *Attorney, Agent, or Firm* — Robert L. Stearns; Dickinson Wright, PLLC

(57) ABSTRACT

A powder metal material comprises pre-alloyed iron-based powder including carbon present in an amount of 0.25 to 1.50% by weight of the pre-alloyed iron-based powder. Graphite is admixed in an amount of 0.25 to 1.50% by weight of the powder metal material. The admixed graphite includes particles finer than 200 mesh in an amount greater than 90.0% by weight of the admixed graphite. Molybdenum disulfide is admixed in an amount of 0.1 to 4.0% by weight of the powder metal material, copper is admixed in an amount of 1.0 to 5.0% by weight of the powder metal material, and the material is free of phosphorous. The powder metal material is then compacted and sintered at a temperature of 1030 to 1150° C. At least 50% of the admixed graphite of the starting powder metal material remains as free graphite after sintering.

13 Claims, 3 Drawing Sheets

U.S. PATENT DOCUMENTS

| | | | | |
|---|---|---|---|---|
| 5,967,110 | A | 10/1999 | Tsutsui et al. | |
| 6,214,080 | B1 * | 4/2001 | Narasimhan et al. | 75/255 |
| 6,228,138 | B1 | 5/2001 | Yamanishi et al. | |
| 6,599,345 | B2 | 7/2003 | Wang et al. | |
| 6,616,726 | B2 | 9/2003 | Chikahata et al. | |
| 6,632,263 | B1 | 10/2003 | Nigarura | |
| 6,679,932 | B2 | 1/2004 | Birler et al. | |
| 6,783,568 | B1 * | 8/2004 | Bowskill et al. | 75/246 |
| 2006/0086204 | A1 | 4/2006 | Ilia | |

FOREIGN PATENT DOCUMENTS

| | | | |
|---|---|---|---|
| KR | 1019990049340 | A | 7/1999 |
| KR | 1020010024478 | A | 3/2001 |

* cited by examiner

IRON-BASED SINTERED POWDER METAL FOR WEAR RESISTANT APPLICATIONS

BACKGROUND OF THE INVENTION

1. Field of the Invention

This invention relates generally to powder metallurgy, and more particularly to iron-based powder metal articles for wear resistant applications, such as automotive valve guides.

2. Description of the Prior Art

Powder metal valve guides and other high temperature wear resistant articles are often formed from iron-based powder metal mixtures. Typically, the articles are formed by admixing various powder additives with an elemental iron powder, and then sintering the mixture at temperatures greater than 1000° C.

Lubricity of the powder metal article is often enhanced by admixing solid lubricants, such as molybdenum disulphide, with the elemental iron powder. Although admixed molybdenum disulphide is an excellent solid lubricant, it tends to undergo undesirable growth during the sintering process when present in amounts large enough to provide sufficient lubricity. The distortion associated with the molybdenum disulphide is detrimental to the manufacture of low cost, high precision, net shape articles, such as valve guides and valve seat inserts. Thus, high levels of molybdenum disulphide are typically avoided in powder metal applications.

Free graphite is another solid lubricant used in powder metal mixtures. Fine graphite particles, such as particles having a U.S. standard sieve designation of about 200 mesh or finer, are preferred over coarse graphite particles because they are easier to process and provide superior mechanical properties in the sintered article. However, the fine graphite particles will readily diffuse into elemental iron powders during sintering, and are thus unavailable to function as solid lubricant in the sintered article. For example, if a powder mixture including 1.0 wt % admixed fine graphite powder is sintered at a temperature above 1000° C., nearly all of the admixed graphite will readily diffuse into the elemental iron matrix during sintering and no significant levels of free graphite will remain in the final sintered article. In order to retain a useful level of free graphite in the final sintered article, it is necessary use admixed graphite having a particle size coarser than 200 mesh, so that the particle size limits diffusion of the admixed graphite into the elemental iron powder during sintering. However, the admixed graphite having a particle size coarser than 200 mesh often leads to processing difficulties and less desirable mechanical properties of the sintered article.

U.S. Pat. No. 5,507,257 discloses an iron-based powder metal mixture for valve guide applications including an elemental iron powder matrix, admixed coarse graphite (200 to 30 mesh), admixed fine graphite (finer than 200 mesh), and admixed ferro-phosphorous or admixed copper-phosphorous powder. As alluded to above, the admixed fine graphite is more reactive than the admixed coarse graphite and readily diffuses into the iron powder matrix during sintering. The admixed coarse graphite is less reactive due to the larger particle size and is specifically incorporated so that a significant level of free graphite is retained in the sintered article. However, as stated above, the admixed coarse graphite is prone to processing difficulties, such as undesirable powder segregation.

The sintered article of the '257 patent includes carbides when the mixture includes admixed molybdenum powder, hard Fe—C—P dispersions in the iron matrix, and free graphite due to the admixed coarse graphite. The admixed phosphorous powders promote sintering through formation of a transient liquid phase and have a stabilizing effect on the alpha-iron phase during sintering. The low carbon solubility in the alpha-iron phase promotes the beneficial presence of the free graphite in the sintered article. However, the admixed phosphorous is detrimental in that the partial liquid phase sintering can cause dimensional change upon solidification to such a degree that the tolerances of the sintered articles for net-shape applications may be adversely affected. Hard phosphorous compounds and cementite form at the grain boundaries as a result of the partial liquid phase sintering. The hard phosphorous compounds and cementite have a detrimental effect on the machinability and net-shape stabilization of the powder metal articles. Thus, the addition of phosphorous in iron-based powder metal applications is typically undesirable.

U.S. Pat. No. 6,632,263 also discloses an iron-based powder metal mixture for valve guide applications. The mixture includes an elemental iron powder matrix, admixed coarse graphite (325 to 100 mesh), admixed fine graphite (finer than 325 mesh), admixed molybdenum disulfide, and admixed copper. Like the mixture of the '257 patent, the admixed fine graphite of the '263 patent is more reactive and readily diffuses into the iron powder matrix during sintering, while the admixed coarse graphite is specifically incorporated to retain a significant level of free graphite in the final sintered article. Again, the admixed coarse graphite is prone to undesirable powder segregation during processing, and the coarse graphite particles may not retain desirable mechanical properties at high temperatures.

SUMMARY OF THE INVENTION AND ADVANTAGES

The powder metal material comprises pre-alloyed iron-based powder and admixed graphite present in an amount of about 0.25 to about 1.50% by weight of the powder metal material. The iron-based powder includes pre-alloyed carbon present in an amount of about 0.25 to about 1.50% by weight of the pre-alloyed iron-based powder. The sintered powder metal article comprises the pre-alloyed iron-based powder including the carbon present in an amount of about 0.25 to about 1.50% by weight of the pre-alloyed iron-based powder. The sintered powder metal article includes the admixed free graphite in an amount of about 0.05 to about 1.50% by weight of the sintered article. The sintered article has a combined carbon content, which includes the carbon of the pre-alloyed iron-based powder and the admixed free graphite, in an amount of about 1.0 to about 2.0% by weight of the sintered article.

The method of forming the starting powder metal material includes pre-alloying the iron-based powder with carbon in an amount sufficient to retain at least about 50% of the admixed graphite as free graphite after sintering the powder metal mixture. The sintered powder metal article is formed by obtaining a powder metal mixture of pre-alloyed iron-based powder including carbon present in an amount of about 0.25 to about 1.50% by weight of the pre-alloyed iron-based powder, admixing graphite powder in an amount of about 0.25 to about 1.50% by weight of the powder metal mixture, and compacting and sintering the powder metal mixture under conditions which retain at least about 50% by weight of the admixed graphite as free graphite in the sintered article.

Pre-alloying the iron-based powder with carbon saturates the iron-based powder with carbon prior to sintering, which prevents the admixed graphite from alloying with the iron-based powder during the sintering process. Thus, at least 50% of the admixed graphite remains as stable free graphite in the sintered article. Unlike the powder metal materials of the prior art, admixed graphite including fine particles, having a U.S. standard sieve designation finer than about 200 mesh in an amount greater than 90% by weight of the admixed graphite, is retained as stable free graphite in the sintered article. Coarse graphite powders are not necessary to retain a significant amount of stable free graphite in the sintered article.

The sintered powder metal article includes enough free graphite to provide excellent lubrication, wear resistance, and other mechanical properties suitable for high wear, high temperature applications, such as automotive valve guides. The powder metal material is easy to process using standard powder handling techniques, provides good machinability, and excellent thermal stability. Processing difficulties associated with coarse graphite particles are avoided because the admixed fine graphite particles do not segregate from the mixture or cause carbon voids in the sintered article. The fine graphite particles maintain excellent mechanical properties at high temperatures. The powder metal material provides excellent dimensional stability for net-shape, high temperature, high wear applications, such as automotive valve guides.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
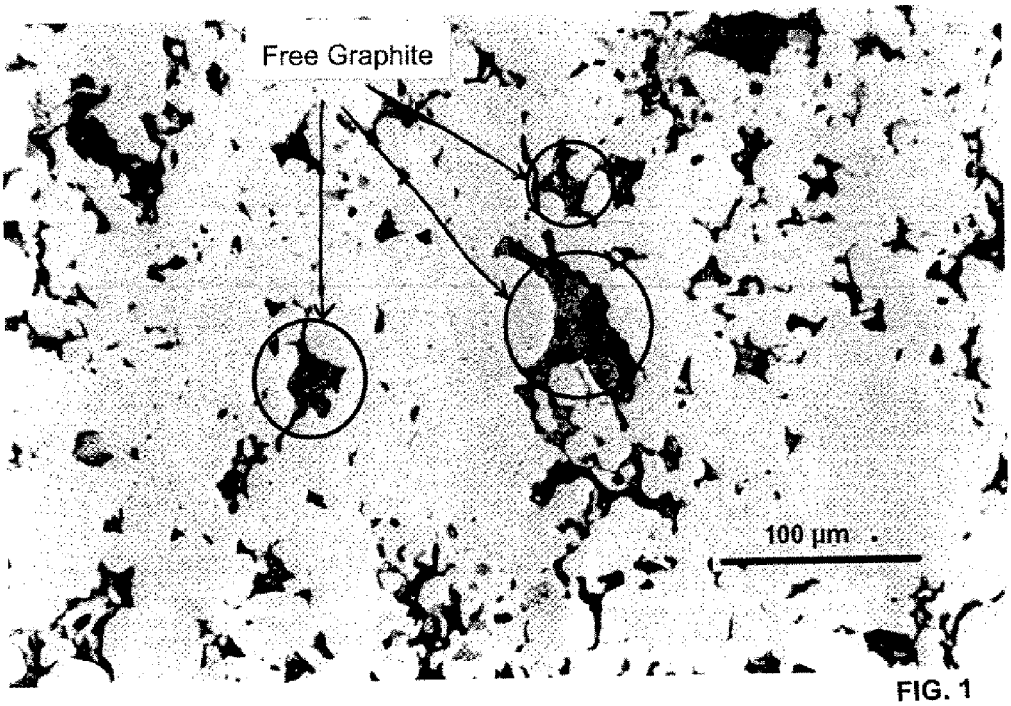
FIG. 1 is a photomicrograph of an exemplary iron-based powder metal material, prepared according to Example 1, with the graphite particles identified.

Referring initially to FIG. 1, a wear resistant iron-based powder metal material is shown. The powder metal material comprises pre-alloyed iron-based powder including carbon, admixed graphite, admixed molybdenum disulfide, and admixed copper. The powder metal material can include additional pre-alloyed elements and impurities. The powder metal material is typically compacted and sintered to form a sintered article having a predetermined net shape and including a substantial amount of free graphite. The sintered article has a combined carbon content, which includes the carbon of the pre-alloyed iron-based powder and the admixed free graphite, in an amount of about 1.0 to about 2.0% by weight of the sintered article. The powder metal material is suitable for demanding wear surface applications, such as valve guides and valve seat inserts of internal combustion engines.

The pre-alloyed iron-based powder including the carbon forms the base of the powder metal material. The carbon is present in an amount of about 0.25 to about 1.50% by weight, and typically about 0.7 to about 1.1% by weight, of the pre-alloyed iron-based powder prior to sintering. After sintering, the carbon is present in an amount of about 0.25 to about 1.50% by weight of the pre-alloyed iron-based powder, depending on the sintering conditions. By pre-alloying the iron-based powder with carbon, the iron-based powder is saturated with carbon prior to sintering, which limits alloying of the admixed graphite powder with the iron-based powder during sintering. As a result, the sintered article includes a substantial amount of stable free graphite. The iron-based powder is pre-alloyed with carbon in an amount sufficient to retain at least about 50% of the admixed graphite as free graphite after sintering the powder metal material. Pre-alloying the iron-based powder with carbon in an amount less than about 0.25% by weight of the iron-based powder does not adequately saturate the iron-based powder and prevent the admixed graphite from alloying with the iron-based powder during the sintering. Typically, the pre-alloyed iron-based powder is fully saturated with carbon in an amount of about 1.20 wt % of the pre-alloyed iron-based powder, so a greater amount of carbon is unnecessary, unless carbon loss occurs due to oxygen content, furnace conditions, or various other factors.

The pre-alloyed iron-based powder includes a predominately pearlitic structure. The pearlitic structure allows the powder metal material to be easily compacted and sintered using standard powder metallurgy techniques. The iron of the pre-alloyed iron-based powder typically has a U.S. standard sieve designation of about 100 mesh. The iron-based powder can include additional alloys to increase the wear resistance or improve other mechanical properties. Molybdenum, nickel, chromium, and manganese, are among the many elements that can improve such properties. Each of these additional alloys are pre-alloyed in the iron-based powder in an amount up to about 3.0% by weight of the pre-alloyed iron-based powder. The iron-based powder can also include small amounts of other additives and impurities.

The admixed graphite of the starting powder metal material is present in an amount of about 0.25 to about 1.50% by weight of the powder metal material. The admixed graphite includes fine particles having a U.S. standard sieve designation finer than about 200 mesh, which is equivalent to a particle size of about 75 microns or less. These fine particles are present in an amount greater than about 90.0% by weight of the admixed graphite. The remaining 10.0% of the graphite has a U.S. standard sieve designation finer than about 100 mesh, which is equivalent to a particle size of about 125 microns or less. As stated above, pre-alloying the iron-based powder with carbon saturates the iron-based powder with carbon prior to sintering and prevents the admixed graphite from alloying with the iron-based powder during the sintering process. Thus, a significant amount of the admixed graphite particles remain as free stable graphite in the sintered powder metal article. At least 50% of the admixed graphite remains as free graphite, unalloyed with the iron-based powder, after sintering. If the pre-alloyed iron-based powder is not fully saturated with carbon, a small amount of the admixed graphite may alloy with the iron powder during sintering, and thus the amount of free graphite present in the sintered article may be slightly less than the amount of admixed graphite present in the starting powder metal material. In the sintered powder metal article, the free graphite is typically present an amount of about 0.05 to about 1.50% by weight of the sintered article.

The free graphite present in the sintered article serves as an excellent solid lubricant. The free graphite also provides excellent wear resistance, strength, and hardness. Processing difficulties associated with coarse graphite particles used in the prior art are avoided because at least 90 wt % of the admixed graphite is 200 mesh or finer. The fine graphite particles are also superior to the coarse graphite particles in maintaining desirable mechanical properties at high temperatures. Thus, the powder metal material including the admixed graphite having a particle size of 200 mesh or finer is particularly suited to high temperature, high wear applications, such as automotive valve guides. As stated above, the sintered article has a combined carbon content, including the carbon of the pre-alloyed iron-based powder and the admixed free graphite, in an amount of about 1.0 to about 2.0% by weight of the sintered article.

The powder metal material may include the admixed molybdenum disulfide in an amount of about 0.1 to about 4.0% by weight of the powder metal material prior to sintering, and less than 4.0% by weight after sintering. The admixed molybdenum disulfide typically has a particle size of about 325 mesh. The admixed molybdenum disulfide also functions as a solid lubricant, and the combination of the free graphite and the admixed molybdenum disulfide provides an especially effective solid lubricant in the sintered article. Admixing the molybdenum disulfide in an amount greater than about 4.0% by weight can cause undesirable growth and distortion of the compacted powder metal mixture during the sintering process. Admixing the molybdenum disulfide in an amount less than about 0.1% by weight may not provide a significant improvement in lubricity of the sintered powder metal article.

The powder metal material includes the admixed copper in an amount of about 1.0 to about 5.0% by weight of the powder metal material prior to sintering, and less than 5.0% by weight after sintering. The admixed copper typically has a particle size of about 100 mesh. During sintering, the admixed copper alloys with the pre-alloyed iron-based powder to provide improved strength and other desired mechanical properties. Admixing the copper in an amount greater than about 5.0% by weight can lead to an embrittled microstructure, while admixing the copper in an amount less than about 1.0% by weight may not provide a significant improvement in the mechanical properties.

Prior to sintering, the powder metal material also includes admixed organic wax, such as ethylene bis-stearamide (EBS), present in an amount of about 0.25 to about 1.50% by weight of the powder metal material, and typically about 0.75 wt %. The EBS wax acts as a fugitive compaction lubricant and lubricates the compaction tooling during the compaction process. However, the EBS wax is subsequently lost during the sintering process, and is undetectable in the sintered article.

The starting powder metal material and sintered powder metal article are both formed without phosphorous. Due to the effectiveness of the pre-alloyed iron-based powder and admixed graphite, phosphorous is not needed to promote or retain free graphite in the sintered powder metal article, as it was in the prior art. Thus, the processing difficulties, distortion of the sintered article, and other undesirable effects associated with phosphorous are avoided.

The sintered powder metal article includes a density of about 6.40 to about 7.10 g/cm$^3$, tested using the ASTM B328 method. The sintered article typically includes a Transverse Rupture Strength (TRS) of about 614 MPa, tested using the ASTM B528 method, and a hardness of about 79 to about 83 according to the Rockwell Hardness B (HRB) scale of hardness measurement, tested using the ASTM E18 method. However, the TRS and hardness of the sintered article changes, and can be higher or lower than the disclosed values, depending on the amount of alloys, additives, and density of the sintered article.

Figure 4:
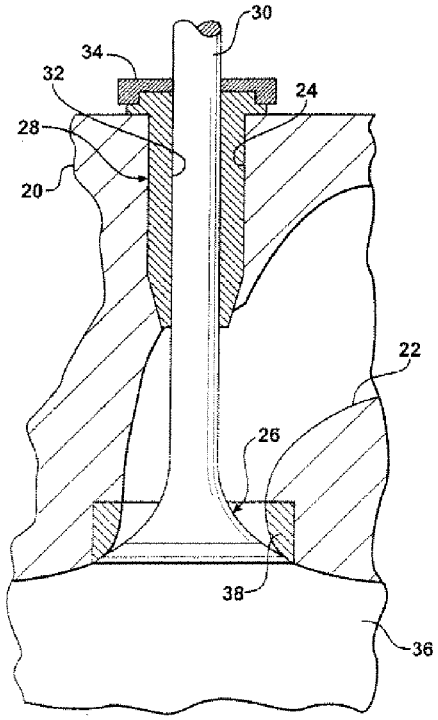
FIG. 4 is a longitudinal cross sectional view of a typical internal combustion engine including a valve guide formed of the exemplary iron-based powder metal material of Example 1.

The sintered powder metal article is used in typical internal combustion engines. Such engines typically include a cylinder head 20 formed with an exhaust or intake passage 22 and a valve passage 24 with a reciprocating valve 26 disposed therein, as shown in FIG. 4. A valve guide 28 for fined of the powder metal material is disposed in the valve passage 24 and functions as a bearing for the reciprocating valve 26. A stem 30 of the valve 26 typically reciprocates at very high speeds in a bore 32 of the valve guide 28. In addition, the valve guide 28 includes a stem seal 34 located at the top of the valve guide 28 to limit the ingress of engine oil down the valve guide bore 32. The valve guide 28 is subject to high temperatures as a result of its proximity to the combustion chamber 36, high speed contact due to the reciprocating valve 26, and marginal lubrication due to the stem seal 34. The powder metal material provides high strength, wear resistance, and lubricity in such harsh conditions. The powder metal material can also be used in other engine components subject to harsh conditions, such as a valve seat insert 38.

As alluded to above, a method of forming the powder metal material includes obtaining a powder metal mixture of pre-alloyed iron-based powder and admixed graphite powder. The powder metal mixture can be formed by pre-alloying carbon in the iron-based powder in an amount sufficient to retain at least about 50% of the admixed graphite as free graphite after sintering the powder metal mixture, typically about 0.25 to about 1.50% by weight of the pre-alloyed iron-based powder. The method can also include pre-alloying the iron-based powder with at least one of molybdenum, nickel, chromium, and manganese. Next, the method includes admixing the graphite, copper, and molybdenum disulfide in the powder metal mixture. The method also includes admixing organic wax, such as ethylene bis-stearamide (EBS), in the powder metal mixture.

The method includes mixing the powder metal mixture, comprising the pre-alloyed iron-based powder including carbon, admixed graphite, admixed copper, admixed molybdenum disulfide, admixed EBS wax, and other additives if present. Typically, the mixing occurs in a Y-cone type mixer or a ploughshare mixer, but other mixers can be used. The mixing typically occurs for about 30 minutes, but the mixing can occur for a longer or shorter period of time, depending on the process conditions and components of the mixture. The method next includes compacting the powder metal mixture and pressing the mixture to a predetermined density. The density of the pressed powder metal material is about 6.40 to about 7.10 g/cm$^3$. Next, the method includes sintering the powder metal mixture in a conventional mesh belt furnace. The sintering typically occurs at a temperature of about 1030 to about 1150° C. The sintering also typically occurs in an atmosphere of about 10% hydrogen and about 90% nitrogen, or in an atmosphere of dissociated ammonia, however the sintering can occur in other atmospheres.

THE SPECIFIC EMBODIMENTS

The following examples are given as particular embodiments of the invention and to demonstrate the practice and advantages thereof. The examples are given by way of illustration and are not intended to limit the specification or the claims in any manner.

Example 1

In a first example, an exemplary sintered powder metal article was prepared from a starting powder metal material including:

1.0 wt % graphite powder, 90.0 wt % having a particle size finer than 200 mesh;

1.0 wt % molybdenum disulfide;

3.0 wt % copper;

94.25 wt % iron-based powder containing 0.94 wt % pre-alloyed carbon; and 0.75 wt % ethylene bis-stearamide (EBS) based organic wax.

The powder metal material was mixed in a Y-cone type mixer for about 30 minutes. The powder mixture was then compacted and pressed into standard TRS test bars having a density of about 6.70 g/cm$^3$. The test bars were sintered in a conventional mesh belt furnace up to 1040° C. in a 10% hydrogen, 90% nitrogen atmosphere. The sintered powder metal article had a transverse rupture strength of 614 MPa, and an average hardness of 83 on the HRB scale. The microstructure of the sintered powder metal article is shown in FIG. 1.

Comparative Example 2

In a second example, the sintered powder metal TRS test bars of Example 1 were compared to standard TRS test bars prepared according to U.S. Pat. No. 5,507,257, to demonstrate improvements in mechanical properties of the sintered article of Example 1. The test bars prepared according to the '257 patent were produced solely for comparative purposes, with the sole intention of showing the improvements achieved by the sintered article of Example 1.

The sintered powder metal article was prepared according to the '257 patent from a starting powder metal material including:

1.0 wt % fine graphite powder, 100.0 wt % having a particle size finer than 200 mesh;

1.0 wt % coarse graphite powder, 100.0 wt % having a particle size of about 200 to about 30 mesh;

3.0 wt % copper;

0.30 wt % phosphorous;

0.75 wt % ethylene bis-stearamide (EBS) based organic wax; and the balance being standard elemental iron powder.

Figure 2:
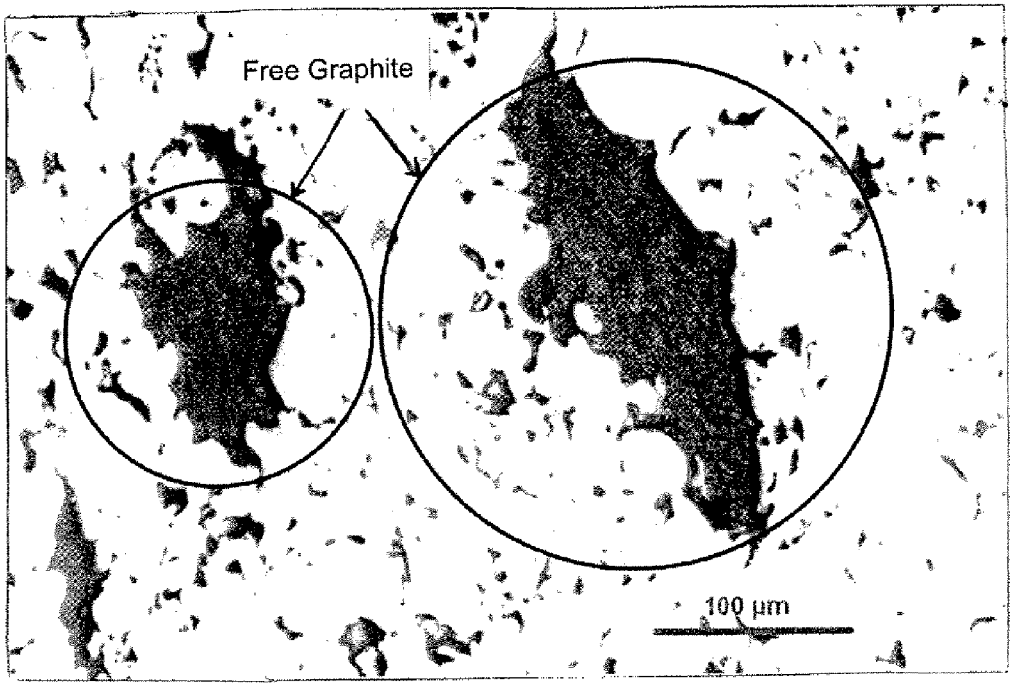
FIG. 2 is a photomicrograph of a comparative iron-based powder metal material, prepared according to Comparative Example 2, with the graphite particles identified.

The coarse graphite powder was carefully sieved to have the particle size of about 200 to about 30 mesh. The starting powder metal material was then mixed in a Y-cone type mixer for about 30 minutes. The powder mixture was then compacted and pressed into standard TRS test bars having a density of about 6.70 g/cm$^3$. The test bars were sintered in a conventional mesh belt furnace up to 1040° C. in a 10% hydrogen, 90% nitrogen atmosphere. The sintered powder metal article had a transverse rupture strength of 440 MPa, and an average hardness of 75 on the HRB scale, so it can be seen that the mechanical properties were significantly lower than the sintered article of Example 1. The microstructure of the sintered powder metal material prepared according to the '257 patent is shown in FIG. 2.

Comparative Example 3

In a third example, the sintered powder metal TRS bars of Example 1 were compared to standard TRS test bars prepared according to U.S. Pat. No. 6,632,263, to further demonstrate improvements in the mechanical properties of the sintered article of Example 1. The test bars prepared according to the '263 patent were produced solely for comparative purposes, with the sole intention of showing the improvement achieved by the sintered article of Example 1.

A sintered powder metal article was prepared according to the '263 patent from a starting powder metal material including:

1.0 wt % fine graphite powder, 100.0 wt % having a particle size finer than 325 mesh;

1.0 wt % coarse graphite powder, 100.0 wt % having a particle size of about 325 to about 100 mesh;

3.0 wt % copper;

1.0 wt % molybdenum disulfide;

0.75 wt % ethylene bis-stearamide (EBS) based organic wax; and the balance being standard elemental iron powder.

Figure 3:
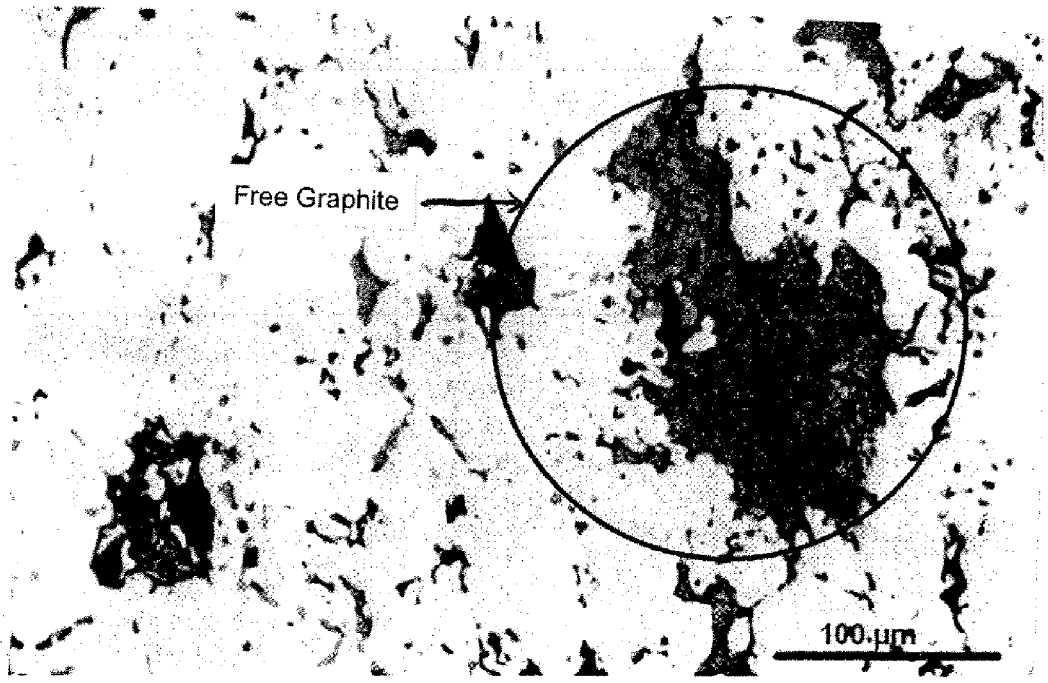
FIG. 3 is a photomicrograph of a comparative iron-based powder metal material, prepared according to Comparative Example 3, with the graphite particles identified.

The coarse graphite powder was carefully sieved to have the particle size of about 325 to about 100 mesh. The powder metal material was mixed in a Y-cone type mixer for about 30 minutes. The powder mixture was then compacted and pressed into standard TRS test bars having a density of about 6.70 g/cm$^3$. The test bars were then sintered in a conventional mesh belt furnace up to 1040° C. in a 10% hydrogen, 90% nitrogen atmosphere. The sintered powder metal article had a transverse rupture strength of 617 MPa, about equal to the sintered article of Example 1, but an average hardness of 75 on the HRB scale, significantly lower than the sintered article of Example 1. The microstructure of the sintered material prepared according to the '263 patent is shown in FIG. 3.

Example 4

In a fourth example, an exemplary sintered powder metal article was prepared from a starting powder metal material including:

1.0 wt % graphite powder, 90.0 wt % having a particle size finer than 200 mesh;

1.0 wt % molybdenum disulfide;

4.0 wt % copper;

93.25 wt % iron-based powder containing 0.94 wt % pre-alloyed carbon; and 0.75 wt % ethylene bis-stearamide (EBS) based organic wax.

The powder metal material was mixed in a Y-cone type mixer for about 30 minutes. The powder mixture was then compacted and pressed into long hollow cylinders, having an outside diameter of 15.2 mm, an inside diameter of 4.5 mm, a length of 55 mm, and a density of 6.65 g/cm$^3$, which represents the size of a typical automotive valve guide. The articles were then sintered in a conventional mesh belt furnace up to 1055° C. in a 10% hydrogen, 90% nitrogen atmosphere. The long cylindrical articles were sintered in the same manner as the much smaller TRS test bars of Example 1. There was no significant distortion or size change of the cylindrical articles during sintering. The sintered powder metal articles had an average hardness of 80 on the HRB scale. The lower hardness values of the sintered long cylindrical articles, compared to the TRS test bars of Example 1, reflects the lower density of the sintered cylindrical articles.

Example 5

In a fifth example, an exemplary sintered powder metal article was prepared from a starting powder metal material including:

1.0 wt % graphite powder, 90.0 wt % having a particle size finer than 200 mesh;

1.0 wt % molybdenum disulfide;

4.0 wt % copper;

93.25 wt % iron-based powder containing 1.01 wt % pre-alloyed carbon; and 0.75 wt % ethylene bis-stearamide (EBS) based organic wax.

The powder metal material was mixed in a Y-cone type mixer for about 30 minutes. The powder mixture was then compacted and pressed into long hollow cylinders, having an outside diameter of 15.2 mm, an inside diameter of 4.5 mm, a length of 60 mm, and a density of 6.60 g/cm$^3$, which represents the size of a typical automotive valve guide. The articles were then sintered in a conventional mesh belt furnace up to 1055° C. in a 10% hydrogen, 90% nitrogen atmosphere. The cylindrical particles were sintered in the same manner as the much smaller TRS test bars of Example 1 and the cylindrical articles of Example 4. There was no significant distortion or size change of the articles during sintering. The sintered powder metal articles had an average hardness of 77 on the HRB scale. The lower hardness of the sintered articles of Example 5, compared to the sintered articles of Examples 1 and 4, reflects the lower density of the articles.

Figure 5:
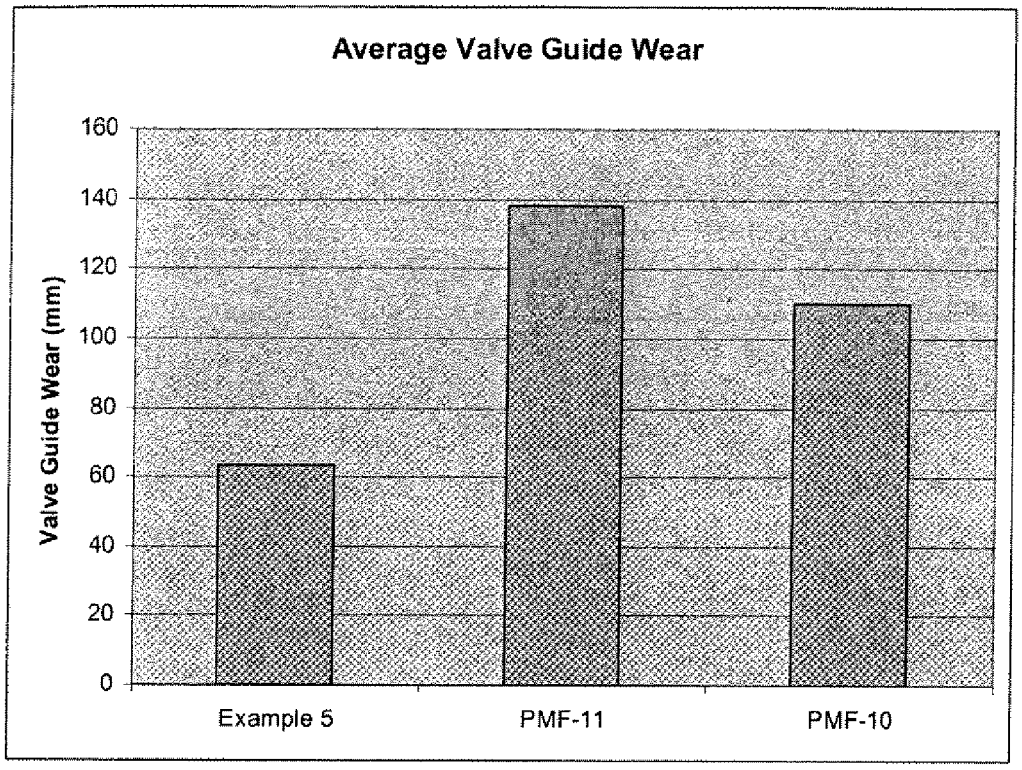
FIG. 5 is a bar graph comparing wear test results of valve guides of Example 5 to wear test results of prior art valve guides.
Figure 6:
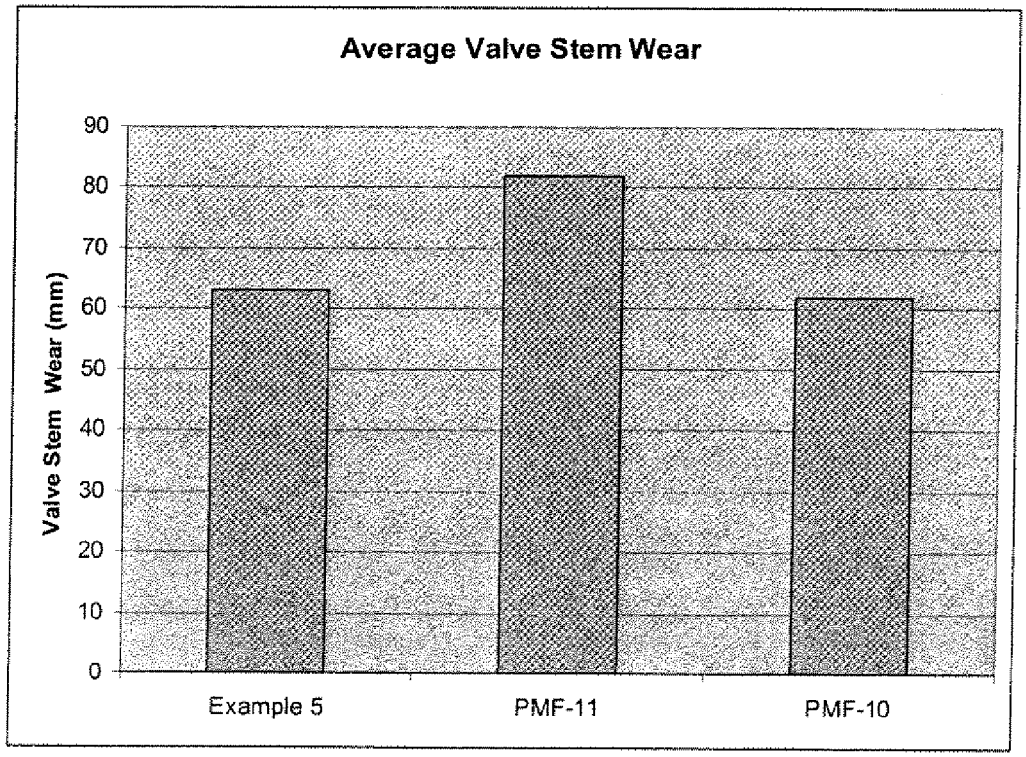
FIG. 6 is a bar graph comparing wear test results of valve stems reciprocating in the valve guides of Example 5 to valve stems reciprocating in the prior art valve guides.

The sintered articles of Example 5 were tested in a Federal-Mogul Valve Guide Bench Rig Wear test machine and compared to existing industry standard materials, PMF-11 and PMF-10. The wear test incorporated heat and side loading into a reciprocating valve stroke action to run a desired valve stem against the internal diameter (I.D.) of the sintered long cylindrical article for a specified duration. The depth of wear into the I.D. of the cylindrical article was measured after testing, and results are shown in FIG. 5. The depth of wear on the valve stem outside diameter (O.D.) was also measured after testing, and results are shown in FIG. 6. The test results show less wear with the powder metal article of Example 5 than with the industry standard materials, PMF-11 and PMF-10.

Example 6

The sintered powder metal articles were also tested in a 2 liter, E85 fueled engine. The sintered powder metal articles were prepared according to Example 5 and then machined into automotive valve guides having an O.D. of about 11 mm, an I.D. of about 5 mm, and a length of about 40 mm. The valve guides were installed in a cylinder head of the 2 liter engine, and the engine ran for a total test time of 300 hours. The wear of each valve guide was determined by comparing the I.D. before and after testing.

Comparative Example 7

In a seventh example, the performance of the valve guides of Example 6 were compared to the performance of existing standard commercial valve guides (grade PMF-11) in the same 2 liter engine. The standard valve guides were manufactured to the same dimensions as the valve guides of Example 6. The valve guides of both Examples 6 and 7 performed acceptably in the 2 liter engine. There was no significant statistical difference between the valve guides of Example 6 and the standard commercial valve guides of Example 7.

Obviously, many modifications and variations of the present invention are possible in light of the above teachings and may be practiced otherwise than as specifically described while within the scope of the appended claims. These recitations should be interpreted to cover any combination in which the inventive novelty exercises its utility. In addition, the reference numerals in the claims are merely for convenience and are not to be read in any way as limiting.

What is claimed is:

1. A powder metal material comprising:

pre-alloyed iron-based powder including carbon present in an amount of about 0.25 to about 1.50% by weight of said pre-alloyed iron-based powder, said pre-alloyed iron-based powder including a pearlitic structure, admixed graphite present in an amount of about 0.25 to about 1.50% by weight of said powder metal material, wherein said admixed graphite consists of particles having a U.S. standard sieve designation finer than 200 mesh present in an amount greater than about 90.0% by weight of said admixed graphite, admixed molybdenum disulfide present in an amount of about 0.1 to about 4.0% by weight of said powder metal material, admixed copper present in an amount of about 1.0 to about 5.0% by weight of said powder metal material, and said powder metal material being free of phosphorous.

2. A powder metal material as set forth in claim 1 wherein said carbon of said pre-alloyed iron-based powder is present in an amount of about 0.25 to less than about 1.1% by weight of said pre-alloyed iron-based powder.

3. A powder metal material as set forth in claim 1 wherein said carbon of said pre-alloyed iron-based powder is present in an amount greater than about 0.7% to about 1.50% by weight of said pre-alloyed iron-based powder.

4. A powder metal material as set forth in claim 1 including intentionally added admixed organic wax present in an amount of about 0.25 to about 1.5% by weight of said powder metal material.

5. A powder metal material as set forth in claim 1 wherein said pre-alloyed iron-based powder forms a balance of the powder metal material.

6. A sintered powder metal article comprising:

pre-alloyed iron-based powder including carbon present in an amount of about 0.25 to about 1.50% by weight of said pre-alloyed iron-based powder, said pre-alloyed iron-based powder including a pearlitic structure, admixed free graphite present in an amount of about 0.05 to about 1.50% by weight of said sintered powder metal material and wherein said admixed graphite consists of particles having a U.S. standard sieve designation finer than 200 mesh intentionally added admixed molybdenum disulfide present in an amount of less than about 4.0% by weight of said sintered powder metal article, intentionally added admixed copper present in an amount of less than about 5.0% by weight of said sintered powder metal article, and said sintered powder metal material being free of phosphorous.

7. A sintered powder metal article as set forth in claim 6 having a density of about 6.40 to 7.10 g/cm$^3$.

8. A sintered powder metal article as set forth in claim 6 formed by sintering said powder metal material at a temperature of about 1030 to 1150° C.

9. A sintered powder metal article as set forth in claim 6 wherein said article comprises a valve guide.

10. A sintered powder metal article as set forth in claim 6 including a combined carbon content present in an amount of about 1.0 to about 2.0% by weight of said sintered article, wherein said combined carbon content includes said carbon of said pre-alloyed iron-based powder and said admixed free graphite.

11. A sintered powder metal article as set forth in claim 6 including a combined carbon content present in an amount of about 1.0 to about 2.0% by weight of said sintered article.

12. A sintered powder metal article as set forth in claim 6 wherein said carbon of said pre-alloyed iron-based powder is present in an amount sufficient to retain at least about 50% of said admixed graphite present prior to sintering as free graphite after sintering.

13. A powder metal material as set forth in claim 11 wherein said pre-alloyed iron-based powder forms a balance of the powder metal material.

* * * * *